United States Patent [19]

Helmick

[11] 4,189,870

[45] Feb. 26, 1980

[54] PATIO DOOR ROLLER ASSEMBLY

[76] Inventor: B. J. Helmick, 303 Deborah Ct., Upland, Calif. 91786

[21] Appl. No.: 955,960

[22] Filed: Oct. 30, 1978

[51] Int. Cl.[2] ..... E05D 13/02

[52] U.S. Cl. ..... 49/420; 49/421; 49/425; 16/105

[58] Field of Search ..... 49/425, 420, 421; 16/105

[56] References Cited

U.S. PATENT DOCUMENTS

| | | | |
|---|---|---|---|
| 2,980,947 | 4/1961 | Rust et al. | 49/425 X |
| 3,175,255 | 3/1965 | Saunders | 49/425 |
| 3,526,995 | 9/1970 | Saunders | 49/425 X |
| 3,716,890 | 2/1973 | Benson | 16/105 X |
| 3,879,893 | 4/1975 | Helmick | 49/425 X |

*Primary Examiner*—Philip C. Kannan
*Attorney, Agent, or Firm*—Boniard I. Brown

[57] ABSTRACT

An adjustable supporting roller device has a roller bracket pivoted on a mounting bracket to be attached to an object to be supported, and a novel combination lead screw and follower assembly for releasibly securing the roller bracket in retracted position during handling and shipment of the object and adjustably extending the roller bracket for use.

8 Claims, 6 Drawing Figures

PATIO DOOR ROLLER ASSEMBLY

BACKGROUND OF THE INVENTION

1. Field of the Invention

This invention relates generally to supporting rollers and more particularly to a novel adjustably supporting roller device for sliding patio doors and other uses.

2. Discussion of the Prior Art

Generally speaking, the invention provides an adjustable supporting roller unit whose supporting roller is adjustable to a retracted position to shield the unit against damage during storage and handling of the object to be supported and to an extended position for use. While capable of a variety of uses, the roller unit is intended primarily for use as a supporting roller for a sliding door, such as a sliding patio door, and will be described in this context.

A conventional sliding patio door installation has a door frame with a track along the lower side of the door frame opening and at least one fixed door panel and one sliding door panel in the frame opening. The sliding panel is moveable edgewise between open and closed positions. To this end, the lower edge of the sliding door panel mounts supporting rollers which ride in the lower door frame track and the upper door edge is guided in the upper side of the frame, as by sliding engagement within a channel along the upper side.

A vast assortment of supporting roller devices have been devised for such sliding doors. Examples of such roller devices are described in my prior U.S. Pat. Nos. 3,443,340; 3,613,313; 3,879,893; 4,064,593.

The present invention is concerned with one problem which is commonly encountered in connection with such doors. The problems referred to stems from the fact that the supporting rollers along the lower door edge are commonly biassed by springs to extended positions wherein the rollers project beyond the edge. In addition, during storage, such doors are often stood upright to rest on their lower edges and during handling and shipment, the doors are often slid on their lower edges across the floors. As a consequence, the spring extended door rollers are frequently damaged during storage and handling.

SUMMARY OF THE INVENTION

This invention provides an improved supporting roller device of the class described which is uniquely constructed and arranged to avoid such roller damage. To this end, the improved roller device has a roller bracket pivoted on a mounting bracket and mounting a supporting roller with its axis generally parallel to the roller bracket pivot axis. A novel combination lead screw and follower assembly is operable to secure the roller bracket in retracted position during storage and handling and to adjustably extend the roller bracket for use. When retracted, the roller bracket and roller are shielded against damage as a result of storage and handling of doors or other roller supported objects in the manner described above. When extended, the rollers are disposed for supporting contact with a supporting surface. In the case of a sliding patio door for example, the roller is retractable upwardly into and extendable downwardly from a channel in the lower door edge.

The lead screw and follower assembly has an axially fixed lead screw which is accessible for rotation by a tool, such as a screwdriver. The follower is threaded on the lead screw for movement toward and away from the roller bracket by rotation of the screw. The roller bracket has a hole in which the tip of the lead screw is adapted to be threaded to secure the bracket in retracted position. Rotation of the screw in one direction initially unthreads the screw from the bracket hole to release roller bracket and then advances the follower against the roller bracket to rotate the latter to extended position.

DESCRIPTION OF THE PREFERRED EMBODIMENT

Figures 1, 2, 3, 4, 5, 6:
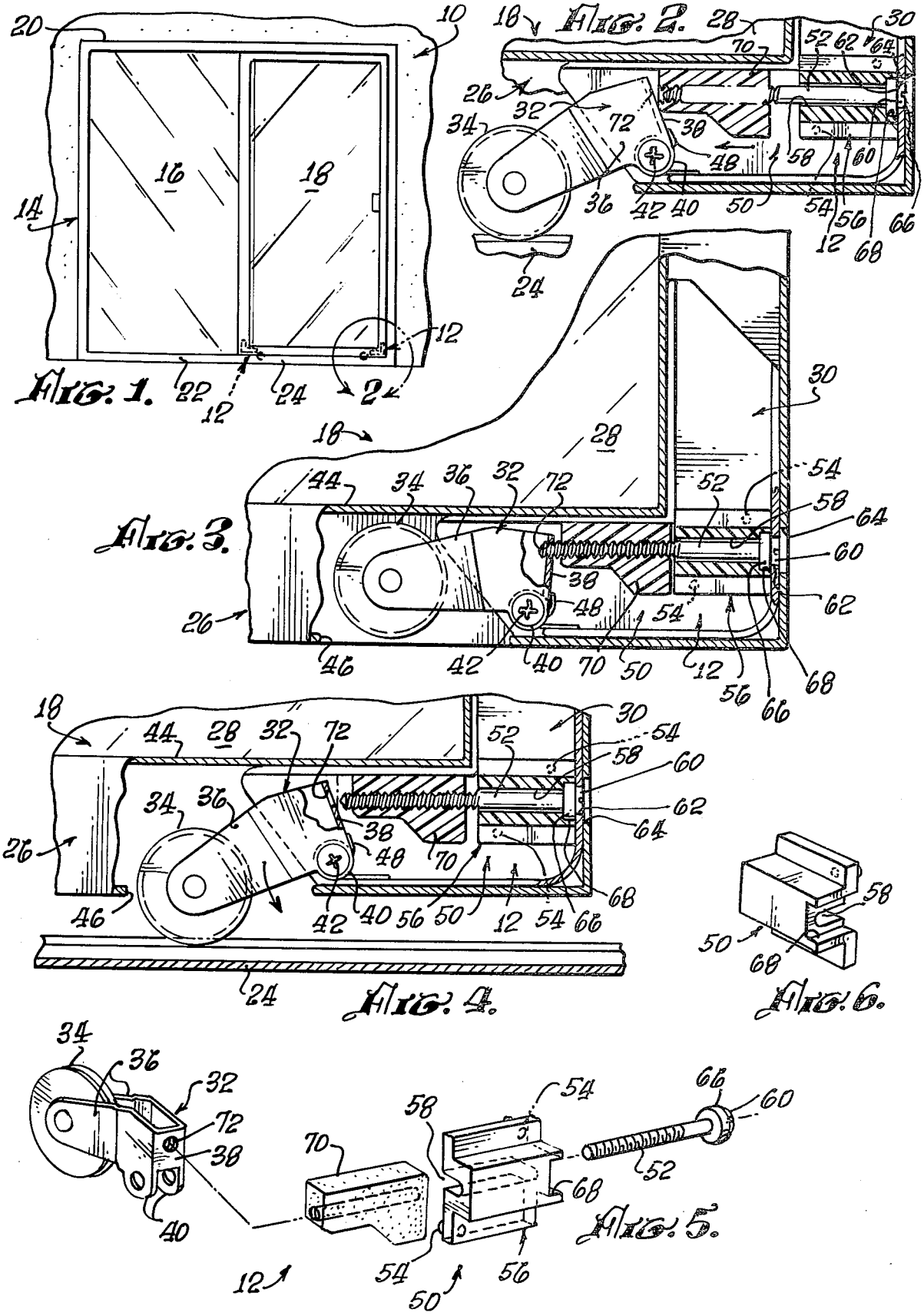
FIG. 1 is a side elevation of a sliding patio door installation embodying a pair of supporting roller devices according to the invention.
FIG. 2 is an enlargement, in section, of the area encircled by the arrow 2 in FIG. 1 showing one of the roller devices in its normal extended condition of use.
FIG. 3 is a section similar to FIG. 2 showing the roller device retracted for handling and storage.
FIG. 4 is a section similar to FIG. 3 showing the roller device in the course of extension of the roller.
FIG. 5 is an exploded perspective view of the roller bracket and lead screw/follower assembly.
FIG. 6 is a perspective view of the lead screw bearing of the device.

Turning first to FIG. 1, reference numeral 10 denotes a sliding patio door installation embodying two supporting roller devices 12 according to the invention. Except for the roller devices 12, the door installation 10 is conventional and hence need not be described in elaborate detail. Suffice it to say that the door installation has a rectangular frame 14 in the opening of which are mounted a fixed or stationary door panel 16 and a moveable or sliding door panel 18. These door panels may be either glass or screen doors. The fixed door panel 16 occupies the left half of the door frame opening in FIG. 1. The sliding door panel 18 is moveable edgewise from its closed position of FIG. 1, wherein it closes the other half of the frame opening, to an open position along side the fixed panel.

The door frame 14 has horizontal top and bottom members 20, 22 and vertical side members. The top frame member 20 has a channel (not shown) slidably receiving the top edge of the sliding door panel 18. The bottom frame member 22 has a track or rail 24 on which the sliding door panel is supported by the roller devices 12 of this invention for edgewise movement of the latter panel between its open and closed positions.

The improved supporting roller device 12 of this invention will now be described by reference to FIGS. 2–6. The sliding door panel 18 has a hollow rectangular frame 26, the opening in which is spanned by a glass or screen 28. A roller device 12 is mounted within each lower corner of the frame 26. The two supporting roller devices are identical so that a description of one will suffice for both.

Roller device 12 has a mounting bracket 30 which, in this instance, is furnished by one of the lower right angle corner brackets of the door frame. These corner brackets are essentially right angle tubular brackets which fit within and join the adjacent ends of the adjacent members of the door frame 26. The lower horizontal end of the mounting bracket 30 opens endwise toward the opposite lower corner of the door frame 26. In addition to the mounting bracket 30, the supporting roller device 12 has a generally U-shaped roller bracket 32 mounting a peripherally grooved roller 34 between the bracket arms 36. The opposite ends of these arms are joined by a connecting portion 38. Along the lower edges of the bracket arms 36 adjacent the connecting portion 38 are depending apertured ears 40.

The closed end of the roller bracket 32, that is the end adjacent the bracket connecting portion 38, fits within the open lower end of the mounting bracket 30 with the axis of the roller 34 generally normal to the plane of the door panel 18. A pivot 42 extends through the vertical side walls of bottom member 44 of the door panel frame 26 and through the holes in the roller bracket ears 40 to pivotally mount the roller bracket on the mounting bracket. The pivot and roller axes are generally parallel to one another and approximately normal to the door panel.

In the bottom wall of the bottom door panel frame member 44 below the roller bracket 32 and roller 34 is an opening 46 through which the roller and bracket are moveable. The roller and roller bracket are rotatable about the pivot 42 between their extended position of FIGS. 1 and 2 and their retracted position of FIG. 3. In extended position, the roller 24 protrudes downwardly through the door frame bottom opening 46 to engage the door frame track 24 in the manner described later. In retracted position, the roller bracket 32 and roller 34 are retracted upwardly into the bottom member 44 of the door panel frame 26. In this retracted position, the roller and bracket are shielded against damages during handling and storage of the door panel 18 in the manner discussed earlier.

Surrounding the roller bracket pivot 42 is a torsion spring 48 which acts between the roller bracket 32 and door panel frame member 44 to urge the bracket to its retracted position. A lead screw and follower assembly 50 is provided for extending the roller bracket and its roller 34.

Lead screw and follower assembly 50 comprises a lead screw 52 extending lengthwise through the lower end of the roller mounting bracket 30. Fixed by rivets 54 to one side wall of the mounting bracket 30 is a generally channel shaped member 56 having a channel 58 which receives the lead screw 52 and is closed by the mounting bracket side wall to form a journal bearing for the lead screw. The lead screw has a slotted head 60 which is accessible through holes 62, 64 in the mounting bracket 30 and door panel frame 26 for rotation by a tool such as a screwdriver. Behind the screw head 60 is an enlarged shoulder 66 which fits within a slot 68 in the end of the lead screw bearing 56 and abuts the edge of the mounting bracket hole 62 to fix the lead screw 52 against axial movement.

The tip end of the lead screw 52 projects beyond the lead screw bearing 56 and mounts a follower block 70. This follower is threaded on the lead screw and fits non-rotatably between the side walls of the roller mounting bracket 30. Rotation of the lead screw thus extends the follower toward or retracts the follower away from the roller bracket 32, depending upon the direction of screw rotation. When the follower is retracted, the tip of the lead screw extends beyond the follower for threaded engagement in a hole 72 in the connecting portion 38 of the roller bracket 32 when the latter is retracted to its position of FIG. 3.

It is now evident that the roller bracket 32 and roller 34 of each supporting roller device 12 may be secured in their retracted position of FIG. 3 by first rotating the lead screw 52 in a direction (preferably counter clockwise) to partially retract the follower 70 to its position of FIG. 4, then forcing the roller bracket against the screw tip, against the action of the bracket spring 48, and continuing rotation of the screw into the roller bracket hole 72 to simultaneously retract the roller bracket and follower to their fully retracted positions of FIG. 3. Extension of each roller bracket 32 and roller 34 to their fully extended positions of FIG. 4 is accomplished by rotation of the lead screw 52 in the opposite direction (preferably clockwise direction) to first unthread the screw from the roller bracket hole 72 and thereby release the roller bracket from the lead screw and then advance the follower 70 against the roller bracket to extend the latter and roller 34 to their fully extended positions of FIG. 2. In these extended positions, the rollers 34 are disposed for engagement with the lower door frame track 24 to support the sliding door panel 18 for opening and closing movement.

The inventor claims:

1. A bottom supporting roller assembly for a sliding door, comprising:
   - a mounting bracket to be installed along the bottom edge of said door,
   - a roller bracket pivot on said mounting bracket on a normally horizontal axis for rotation between extended and retracted positions relative to said mounting bracket,
   - a roller on said roller bracket having its axis parallel to said pivot axis,
   - a rotary axially stationary combined lead and lock screw journaled in said mounting bracket with its axis normal to and laterally spaced from said pivot axis and having a tip end engageable in a threaded hole in said roller bracket when the latter bracket occupies its retracted position to releasibly secure said roller bracket in said retracted position, and
   - a non-rotatable follower member threaded on said screw, whereby rotation of said screw in one direction unthreads said screw from said roller bracket to release said roller bracket for extension and thereafter advances said follower member against said roller bracket to extend said roller bracket.

2. The roller assembly according to claim 1, wherein:
   - said mounting bracket has opposite ends, and
   - said roller bracket is mounted on one end of said mounting bracket and said screw is accessible at the other end of said mounting bracket for rotation of the screw.

3. The roller assembly according to claim 2, wherein:
   - said door has a channel along said bottom edge and one vertical edge which meet at one lower corner of the door,
   - said mounting bracket is L-shaped to be installed within said corner with one bracket leg in said bottom channel and the other bracket leg in said side channel,
   - said roller bracket is mounted at the outer free end of said one bracket leg with its pivot axis normal to the common plane of said legs,
   - said screw extends lengthwise of and is accessible at the other end of said one bracket leg, and
   - said roller is extendable beyond the side of said one bracket leg opposite the other bracket leg and is retractable toward the opposite side of said one bracket leg.

4. The roller assembly according to claim 3, wherein:
   - said one bracket leg has spaced side walls, and said roller bracket, screw, and follower member are disposed between said side walls.

5. In combination:

a sliding door having a channel along its bottom edge, a mounting bracket installed within said channel, a roller bracket pivoted on said mounting bracket on a normally horizontal axis, a roller on said roller bracket having its axis parallel to said pivot axis, said roller bracket being rotatable in one direction on its pivot axis to extend said roller downwardly relative to said door and in the opposite direction to retract said roller upwardly relative to said door to a retracted protected position within said channel, a rotary axially stationary combined lead and lock screw generally parallel to said bottom door edge journaled in said mounting bracket with its axis normal to and laterally spaced from said pivot axis and having a tip end engageable in a threaded hole in said roller bracket when said roller bracket occupies said retracted position to releasibly secure said roller bracket in said retracted position, a non-rotatable follower member threaded on said screw, whereby rotation of said screw in one direction unthreads said screw from said roller bracket to release said roller bracket for extension and thereafter advances said follower member against said roller bracket to extend said roller bracket, and said door having an opening through which said screw is accessible for rotation.

6. The combination of claim 5, wherein:

said mounting bracket extends lengthwise of said bottom door channel adjacent one bottom corner of the door, and said roller bracket is mounted on the end of said mounting bracket remote from the adjacent vertical door edge and said screw is accessible for rotation at the other end of said mounting bracket through an opening in said vertical door edge.

7. The combination of claim 6, wherein:

said door has a channel along said vertical edge which meets said bottom channel at said bottom door corner, said mounting bracket is L-shaped and has one leg disposed within said bottom channel and a second leg disposed within said side channel, and said roller bracket is mounted on said one bracket leg with its pivot axis normal to the common plane of said leg.

8. The combination of claim 7, wherein:

said one bracket leg has spaced side walls parallel to the plane of said door, and said roller bracket, screw and follower member are disposed between said bracket side walls.

* * * * *